US007001483B2

(12) United States Patent
Severeid et al.

(10) Patent No.: US 7,001,483 B2
(45) Date of Patent: Feb. 21, 2006

(54) APPARATUS FOR MAKING CARBOXYLATED PULP FIBERS

(75) Inventors: David E. Severeid, Puyallup, WA (US); Richard A. Jewell, Tacoma, WA (US); Joseph L. Komen, Bothell, WA (US); S. Ananda Weerawarna, Seattle, WA (US); Bing Su, Federal Way, WA (US)

(73) Assignee: Weyerhaeuser Company, Federal Way, WA (US)

( * ) Notice: Subject to any disclaimer, the term of this patent is extended or adjusted under 35 U.S.C. 154(b) by 85 days.

(21) Appl. No.: 10/635,097

(22) Filed: Aug. 5, 2003

(65) Prior Publication Data

US 2005/0028952 A1 Feb. 10, 2005

(51) Int. Cl.
*D21C 9/00* (2006.01)

(52) U.S. Cl. ..... 162/9; 162/52; 162/57; 162/241; 162/246; 162/66; 162/157.6; 162/181.2; 162/67; 8/115.5; 8/116.1

(58) Field of Classification Search ..... 162/9, 162/57, 52, 66, 157.6, 181.2, 175, 146, 241, 162/243, 246, 233, 252, DIG. 5; 8/115.5
See application file for complete search history.

(56) References Cited

U.S. PATENT DOCUMENTS

| | | | | |
|---|---|---|---|---|
| 3,575,177 | A | 4/1971 | Briskin et al. | |
| 4,100,341 | A | 7/1978 | Brasey et al. | |
| 4,401,810 | A | 8/1983 | Tang et al. | |
| 4,480,089 | A | 10/1984 | Chen et al. | |
| 4,505,775 | A | 3/1985 | Harding et al. | |
| 4,679,278 | A | 7/1987 | Caumont | |
| 5,389,201 | A * | 2/1995 | Tsai | 162/57 |
| 5,667,637 | A | 9/1997 | Jewell et al. | |
| 5,755,828 | A | 5/1998 | Westland | |
| 5,824,462 | A | 10/1998 | Ashida et al. | |
| 6,031,101 | A | 2/2000 | Devine et al. | |
| 6,117,883 | A | 9/2000 | Merritt et al. | |
| 6,127,573 | A | 10/2000 | Li et al. | |
| 6,228,126 | B1 | 5/2001 | Cimecioglu et al. | |
| 6,340,409 | B1 * | 1/2002 | Shackford | 162/52 |
| 6,379,494 | B1 | 4/2002 | Jewell et al. | |
| 6,409,881 | B1 | 6/2002 | Jaschinski | |
| 6,447,644 | B1 | 9/2002 | Seltzer et al. | |
| 2002/0072600 | A1 | 6/2002 | Bragd et al. | |

FOREIGN PATENT DOCUMENTS

| | | |
|---|---|---|
| EP | 0 574 666 A1 | 4/1993 |
| EP | 1 077 221 A1 | 2/2001 |
| EP | 1 077 285 A1 | 2/2001 |
| EP | 1 077 286 A1 | 2/2001 |
| FR | 2674528 | 10/1992 |
| JP | 2001/49591 | 2/2001 |
| WO | WO 95/07303 | 3/1995 |
| WO | WO 96/36621 | 11/1996 |
| WO | WO 96/38484 | 12/1996 |
| WO | WO 98/27117 | 6/1998 |
| WO | WO 99/23117 | 5/1999 |
| WO | WO 99/57158 | 11/1999 |
| WO | WO 00/50388 | 8/2000 |
| WO | WO 00/50462 | 8/2000 |
| WO | WO 00/50463 | 8/2000 |
| WO | WO 00/50621 | 8/2000 |
| WO | WO 00/56978 | 9/2000 |
| WO | WO 01/29309 | 4/2001 |
| WO | WO 01/23657 | 5/2001 |

OTHER PUBLICATIONS

Andersson, R., J. Hoffman, N. Nahar and E. Scholander. An n.m.r. study of the products of oxidation of cellulose and (1→4)-β-D-xylan with sodium nitrite in orthophosphoric acid. *Carbohydrate Research*206: 340-346 (1990).

Anelli, P.L., S. Banfi, F. Montanari and S. Quichi. Oxidation of diols with alkali hypochlorites catalyzed by oxammonium salts under two-phase conditions. *Journal of Organic Chemistry*54: 2970-2972 (1989).

Barzyk, D., D.H. Page and A. Ragauskas. Acidic group topochemistry and fibre-to-fibre bond strength. *Journal of Pulp and Paper Science*23(2): J59-J61 (1997).

Barzyk, D., D. H. Page and A. Ragauskas. Carboxylic acid groups and fibre bonding. In *The Fundamentals of Papermaking Materials: Transactions of 11th Fundamental Research Symposium*, Cambridge, 2: 893-907 (Sep. 1997).

Besemer, A. C., A. E. J. de Nooy and H. van Bekkum. Methods for selective oxidation of cellulose: Preparation of 2,3-dicarboxycellulose and 6-carboxy-cellulose. In *Cellulose Derivatives*, T. J. Heinze and W. G. Glasser eds., Ch. 5, pp 73-82 (1996).

Chang, P. S. and J. F. Robyt. Oxidation of Primary alcohol groups of naturally Occurring polysaccharides with 2,2,6,6-tetramethylpiperidine oxoammonium ion. *Journal of Carbohydrate Chemistry*15(7): 819-830 (1996).

Datye, K. V. and G. M. Nabar. Studies in the reaction of formaldehyde with unmodified, modified and dyed celluloses. Part III: The reaction of formaldehyde and oxycelluloses. *Textile Research Journal*33(7): 500-510 (1963).

Davis, N. J. and S. L. Flitsch. Selective oxidation of monosaccharide derivatives to uronic acids. *Tetrahedron Letters*34(7): 1181-1184 (1993).

Einhorn, J., C. Einhorn, F. Ratajczak and J-L. Pierre. efficient and highly selective oxidation of primary alcohols to aldehydes by *N*-chlorosuccinimide mediated by oxammonium salts. *Journal of Organic Chemistry*61: 7452-7454 (1996).

(Continued)

*Primary Examiner*—Mark Halpern

(57) ABSTRACT

An apparatus for carboxylating wood pulp which utilizes the wood pulp bleach plant and the method of carboxylating the pulp which takes place in the bleach plant.

20 Claims, 3 Drawing Sheets

OTHER PUBLICATIONS

Ganiev, I.M., Q. K. Timerghazin, A. F. Kalizov, V. V. Shereshovets, I. M. Grigor'ev and G. A. Tolskitov. Complex of Chlorine dioxide with TEMPO and its conversion into oxoammonium salt. *Journal of Physical Organic Chemistry*14:38-42 (2001).

Isogai, A. Application of stable nitroxyl radical reagents to cellulose modification. *Cellulose Communications*5: 153-164 (1998).

Isogai, A. and Y. Kato. Preparation of polyuronic acid from cellulose by TEMPO-mediated oxidation. *Cellulose*5: 153-164 (1998).

Kitaoka, T., A. Isogai and F. Onabe. Surface modification of pulp fibers by TEMPO-mediated oxidation. *Sen'i Gakukai* Preprint 1998.

Kitaoka, T., A. Isogai and F. Onabe. Chemical modification of pulp fibers by TEMPO-mediated oxidation. *Nordic Pulp and Paper Research Journal*14 (4): 279-284 (1999).

luner, P., K. P. Vemuri and B. Leopold. the effect of chemical modification on the Mechanical properties of paper. II. Wet strength of oxidized springwood and summerwood southern pine kraft fibers. *Tappi*50(3): 1127-120 (1967).

Luner, P., K. P. Vemuri and F. Womeldorff. The effect of chemical modification on the mechanical properties of paper. III. Dry strength of oxidized springwood and summerwood southern pine kraft fibers. *Tappi* 50(5): 227-230 (1967).

de Nooy, A. E. J., A. C. Besemer and H. van Bekkum. Highly selective TEMPO-mediated oxidation of pro,ary alcohol groups in polysaccharides. *Receuil des Traveau Chimiques des Pays-Bas*113(3): 165-166 (1994).

de Nooy, A. E. J., A. C. Besemer and H. van Bekkum. Highly selective nitroxyl radical-mediated oxidation of primary alcohol groups in water soluble glucans. *Carbohydrate Research*269:89-98 (1995).

de Nooy, A. E. K., A. C. Besemer and H. van Bekkum. On the use of stable organic nitroxyl radicals for the oxidation of primary and secondary alcohols. *Synthesis: Journal of Synthetic Organic Chemistry* Oct. 1996 pp 1163-1174.

Rapson WH, "The General Principles of Pulp Bleaching," The Bleachign of Pulp, 1963, CH. 2, pp. 8-9.

Shenai, V. A. and A. S. Narkhede. Hypochlorite oxidation of cellulose in the presence of cobalt sulfide. *Textile Dyer and Printer*20: 17-22 (19870.

Shet, R. T. and A. M. Yabani. Crease-recovery and tensile-strength properties of unmodified and modified cotton cellulose treated with cross-linking agents. *Textile research Journal*51(11): 740-744 (1981).

Young, R. A. Bonding of Oxidized cellulose fibers and interaction with wet strength resins. *Wood and Fiber*10(2): 112-119 (1978).

Zhao, M., J. Li, E. Mano, Z. Song, D. M. Tschaen, E. J. J. Grabowski and P. J. Reider. Oxidation of primary alcohols to carboxylic acids with sodium chlorite catalyzed by TEMPO and bleach. *Journal of Organic Chemistry*64: 2564-2566 (1999).

* cited by examiner

APPARATUS FOR MAKING CARBOXYLATED PULP FIBERS

FIELD OF THE INVENTION

The present invention relates to incorporation of a carboxylation system into the bleach plant of a wood pulp mill to provide carboxylated cellulosic fibers.

BACKGROUND OF THE INVENTION

Cellulose is a carbohydrate consisting of a long chain of glucose units, all β-linked through the 1'-4 positions. Native plant cellulose molecules may have upwards of 2200 anhydroglucose units. The number of units is normally referred to as degree of polymerization (D.P.). Some loss of D.P. inevitably occurs during purification. A D.P. approaching 2000 is usually found only in purified cotton linters. Wood derived celluloses rarely exceed a D.P. of about 1700. The structure of cellulose can be represented as follows:

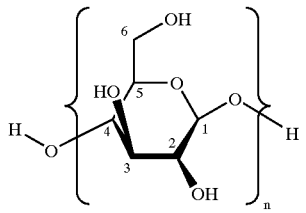

Chemical derivatives of cellulose have been commercially important for almost a century and a half. Nitrocellulose plasticized with camphor was the first synthetic plastic and has been in use since 1868. A number of cellulose ether and ester derivatives are presently commercially available and find wide use in many fields of commerce. Virtually all cellulose derivatives take advantage of the reactivity of the three available hydroxyl groups (i.e., C2, C3, and C6). Substitution at these groups can vary from very low, about 0.01, to a maximum of 3. Among important cellulose derivatives are cellulose acetate, used in fibers and transparent films; nitrocellulose, widely used in lacquers and gunpowder; ethyl cellulose, widely used in impact resistant tool handles; methyl cellulose, hydroxyethyl, hydroxypropyl, and sodium carboxymethyl cellulose, water soluble ethers widely used in detergents, as thickeners in foodstuffs, and in papermaking. Cellulose itself has been modified for various purposes. Cellulose fibers are naturally anionic in nature, as are many papermaking additives. A cationic cellulose is described in U.S. Pat. No. 4,505,775, issued to Harding et al. This cellulose has greater affinity for anionic papermaking additives such as fillers and pigments and is particularly receptive to acid and anionic dyes. U.S. Pat. No. 5,667,637, issued to Jewell et al., describes a low degree of substitution (D.S.) carboxyethyl cellulose which, along with a cationic resin, improves the wet to dry tensile and burst ratios when used as a papermaking additive. U.S. Pat. No. 5,755,828, issued to Westland, describes a method for increasing the strength of articles made from crosslinked cellulose fibers having free carboxylic acid groups obtained by covalently coupling a polycarboxylic acid to the fibers.

For some purposes, cellulose has been oxidized to make it more anionic to improve compatibility with cationic papermaking additives and dyes. Various oxidation treatments have been used. Among these are nitrogen dioxide and periodate oxidation coupled with resin treatment of cotton fabrics for improvement in crease recovery as suggested by Shet, R. T. and A. M. Nabani, *Textile Research Journal,* November 1981: 740–744. Earlier work by Datye, K. V. and G. M. Nabar, *Textile Research Journal,* July 1963: 500–510, describes oxidation by metaperiodates and dichromic acid followed by treatment with chlorous acid for 72 hours or 0.05 M sodium borohydride for 24 hours. Copper number was greatly reduced by borohydride treatment and less so by chlorous acid. Carboxyl content was slightly reduced by borohydride and significantly increased by chlorous acid. The products were subsequently reacted with formaldehyde. Southern pine kraft springwood and summer wood fibers were oxidized with potassium dichromate in oxalic acid. Luner, P., et al., *Tappi* 50(3):117–120 (1967). Handsheets made with the fibers showed improved wet strength believed to be due to aldehyde groups. Pulps have also been oxidized with chlorite or reduced with sodium borohydride. Luner, P., et al., *Tappi* 50(5):227–230, 1967. Handsheets made from pulps treated with the reducing agent showed improved sheet properties over those not so treated. Young, R. A., *Wood and Fiber* 10(2):112–119, 1978 describes oxidation primarily by dichromate in oxalic acid to introduce aldehyde groups in sulfite pulps for wet strength improvement in papers. Shenai, V. A. and A. S. Narkhede, *Textile Dyer and Primer,* May 20, 1987: 17–22 describes the accelerated reaction of hypochlorite oxidation of cotton yarns in the presence of physically deposited cobalt sulfide. The authors note that partial oxidation has been studied for the past hundred years in conjunction with efforts to prevent degradation during bleaching. They also discuss in some detail the use of 0.1 M sodium borohydride as a reducing agent following oxidation. The treatment was described as a useful method of characterizing the types of reducing groups as well as acidic groups formed during oxidation. The borohydride treatment noticeably reduced copper number of the oxidized cellulose. Copper number gives an estimate of the reducing groups such as aldehydes present on the cellulose. Borohydride treatment also reduced alkali solubility of the oxidized product, but this may have been related to an approximate 40% reduction in carboxyl content of the samples. Andersson, R., et al. in *Carbohydrate Research* 206: 340–346 (1990) describes oxidation of cellulose with sodium nitrite in orthophosphoric acid and describe nuclear magnetic resonance elucidation of the reaction products.

Davis, N. J., and S. L. Flitsch, *Tetrahedron Letters* 34(7): 1181–1184 (1993) describe the use and reaction mechanism of 2,2,6,6-tetramethylpiperidinyloxy free radical (TEMPO) with sodium hypochlorite to achieve selective oxidation of primary hydroxyl groups of monosaccharides. Following the Davis et al. paper this route to carboxylation then began to be more widely explored. de Nooy, A. E. J., et al., *Receuil des Travaux Chimiques des Pays-Bas* 113: 165–166 (1994) reports similar results using TEMPO and hypobromite for oxidation of primary alcohol groups in potato starch and inulin. The following year, these same authors in *Carbohydrate Research* 269:89–98 (1995) report highly selective oxidation of primary alcohol groups in water soluble glucans using TEMPO and a hypochlorite/bromide oxidant.

WO 95/07303 (Besemer et al.) describes a method of oxidizing water soluble carbohydrates having a primary alcohol group, using TEMPO with sodium hypochlorite and sodium bromide. Cellulose is mentioned in passing in the background although the examples are principally limited to starches. The method is said to selectively oxidize the primary alcohol at C-6 to carboxylic acid group. None of the products studied were fibrous in nature.

WO 99/23117 (Viikari et al.) describes oxidation using TEMPO in combination with the enzyme laccase or other enzymes along with air or oxygen as the effective oxidizing agents of cellulose fibers, including kraft pine pulps.

A year following the above noted Besemer publication, the same authors, in *Cellulose Derivatives,* Heinze, T. J. and W. G. Glasser, eds., Ch. 5, pp. 73–82 (1996), describe methods for selective oxidation of cellulose to 2,3-dicarboxy cellulose and 6-carboxy cellulose using various oxidants. Among the oxidants used were a periodate/chlorite/hydrogen peroxide system, oxidation in phosphoric acid with sodium nitrate/nitrite, and with TEMPO and a hypochlorite/bromide primary oxidant. Results with the TEMPO system were poorly reproduced and equivocal. In the case of TEMPO oxidation of cellulose, little or none would have been expected to go into solution. The homogeneous solution of cellulose in phosphoric acid used for the sodium nitrate/sodium nitrite oxidation was later treated with sodium borohydride to remove any carbonyl function present.

Chang, P. S. and J. F. Robyt, *Journal of Carbohydrate Chemistry* 15(7):819–830 (1996), describe oxidation of ten polysaccharides including α-cellulose at 0 and 25° C. using TEMPO with sodium hypochlorite and sodium bromide. Ethanol addition was used to quench the oxidation reaction. The resulting oxidized α-cellulose had a water solubility of 9.4%. The authors did not further describe the nature of the α-cellulose. It is presumed to have been a so-called dissolving pulp or cotton linter cellulose. Barzyk, D., et al., in *Transactions of the* 11*th Fundamental Research Symposium,* Vol. 2, 893–907 (1997), note that carboxyl groups on cellulose fibers increase swelling and impact flexibility, bonded area and strength. They designed experiments to increase surface carboxylation of fibers. However, they ruled out oxidation to avoid fiber degradation and chose to form carboxymethyl cellulose in an isopropanol/methanol system.

Isogai, A. and Y. Kato, in *Cellulose* 5:153–164, 1998 describe treatment of several native, mercerized, and regenerated celluloses with TEMPO to obtain water soluble and insoluble polyglucuronic acids. They note that the water soluble products had almost 100% carboxyl substitution at the C-6 site. They further note that oxidation proceeds heterogeneously at the more accessible regions on solid cellulose.

Kitaoka, T., A. Isogai, and F. Onabe, in *Nordic Pulp and Paper Research Journal* 14(4):279–284, 1999, describe the treatment of bleached hardwood kraft pulp using TEMPO oxidation. Increasing amounts of carboxyl content gave some improvement in dry tensile index, Young's modulus, and brightness, with decreases in elongation at breaking point and opacity. Other strength properties were unaffected. Retention of PAE-type wet strength resins was somewhat increased. The products described did not have any stabilization treatment after the TEMPO oxidation.

U.S. Pat. No. 6,379,494 describes a method for making stable carboxylated cellulose fibers using a nitroxide-catalyzed process. In the method, cellulose is first oxidized by nitroxide catalyst to provide carboxylated as well as aldehyde and ketone substituted cellulose. The oxidized cellulose is then stabilized by reduction of the aldehyde and ketone substituents to provide the carboxylated fiber product. Nitroxide-catalyzed cellulose oxidation occurs predominately at the primary hydroxyl group on C-6 of the anhydroglucose moiety. In contrast to some of the other routes to oxidized cellulose, only very minor oxidation occurs at the secondary hydroxyl groups at C-2 and C-3.

In nitroxide oxidation of cellulose, primary alcohol oxidation at C-6 proceeds through an intermediate aldehyde stage. In the process, the nitroxide is not irreversibly consumed in the reaction, but is continuously regenerated by a secondary oxidant (e.g., hypohalite) into the nitrosonium (or oxyammonium or oxammonium) ion, which is the actual oxidant. In the oxidation, the nitrosonium ion is reduced to the hydroxylamine, which can be re-oxidized to the nitroxide. Thus, in the method, it is the secondary oxidant (e.g., hypohalite) that is consumed. The nitroxide may be reclaimed or recycled from the aqueous system.

The resulting oxidized cellulose product is an equilibrium mixture including carboxyl and aldehyde substitution. Aldehyde substituents on cellulose are known to cause degeneration over time and under certain environmental conditions. In addition, minor quantities of ketone may be formed at C-2 and C-3 of the anhydroglucose units and these will also lead to degradation. Marked degree of polymerization loss, fiber strength loss, crosslinking, and yellowing are among the consequent problems. Thus, to prepare a stabilized carboxylated product, aldehyde and ketone substituents formed in the oxidation step are reduced to hydroxyl groups, or aldehyde substituents are oxidized to a carboxyl group in a stabilization step.

In addition to TEMPO, other nitroxide derivatives for making carboxylated cellulose fibers have been described. See, for example, U.S. Pat. No. 6,379,494 and WO 01/29309, Methods for Making Carboxylated Cellulose Fibers and Products of the Method.

A method of preparation of carboxylic acids or their salts by oxidation of primary alcohols using hindered N-chloro hindered cyclic amines and hypochlorite, in aqueous solutions or in mixed solvent systems containing ethyleneglycol dimethyl ether, diethyleneglycol dimethyl ether, triethyleneglycol dimethyl ether, toluene, acetonitrile, ethylacetate, t-butanol and other solvents is described in JP10130195, "Manufacturing Method of Carboxylic Acid and Its Salts". Other oxidants described include chlorine, hypobromite, bromite, trichloro isocyanuric acid, tribromo isocyanuric acid, or combinations.

Despite the advances made in the development of methods for making carboxylated cellulose pulps including catalytic oxidation systems, there remains a need for improved methods and catalysts for making carboxylated cellulose pulp. The present invention seeks to fulfill these needs and provides further related advantages.

SUMMARY OF THE INVENTION

A carboxylation system and process for wood pulp which may be placed in an existing pulp mill bleach plant, or incorporated into a new bleach plant with little additional equipment. A carboxylation system and process for wood pulp which will allow the mill to transition from regular pulp to carboxylated pulp and back with ease.

What is needed is a process and equipment that allows pulp to be carboxylated in an existing pulp mill without large capital costs.

Long reaction times require large tanks, land on which to put the tanks and a great deal of capital. One of the aspects of the present carboxylation reaction is the ability to place the needed equipment into the confines of an existing pulp mill bleach plant. This required reducing the time of reaction so that it could take place within the confines of the equipment in the plant.

A wood pulp carboxylation system has a first stage in which the pulp is oxidized to provide a pulp containing both carboxyl and aldehyde functional groups and second stage in which the aldehyde groups are converted to carboxyl groups. The first stage is a carboxylation stage and the second stage is a stabilization stage.

It was initially thought that the first stage of carboxylation would require at least 15 minutes so that carboxylating wood pulp would require two additional units after the bleach plant. The first unit would be a tank for the carboxylation process and the second unit would be another tank for the stabilization reaction. These would be expensive to install.

After much work the time for the first stage was reduced to 2 minutes. This still required a separate tank for the first stage carboxylation.

Additional work reduced the time for the first stage to 1 minute. The carboxylation unit could be placed between the extraction stage and the chlorine dioxide stage of the bleach plant, but additional piping was required to provide the necessary reaction time. The chlorine dioxide tower could be used for the stabilization reaction. Again the carboxylation unit would be expensive to install, though not as expensive as with longer reaction times.

Additional work reduced the first stage reaction time to 30 seconds or less. Now it was possible to use the existing pulp mill equipment with only the addition of mixers and supply lines and supply storage.

By using advantageous chemical loadings and chemicals it was found that the time for the first stage of carboxylation could be shortened into a range of less than a minute. Times of 1 second to 60 seconds are preferred and times of 5 to 30 seconds most preferred.

The first stage of the carboxylation unit can now be a short length of pipe between the extraction stage washer and the chlorine dioxide tower. The length and diameter of pipe will depend on the time required for the first stage of carboxylation process. The chlorine dioxide tower can be the stabilization unit. In mills which have two chlorine dioxide towers with a washer between them, the unit for the first stage of carboxylation can be placed between the first chlorine dioxide washer and the second chlorine dioxide tower.

Another aspect was to use chemicals normally found at the pulp mill and keep new chemicals to a minimum.

DETAILED DESCRIPTION OF THE INVENTION

Figure 1:
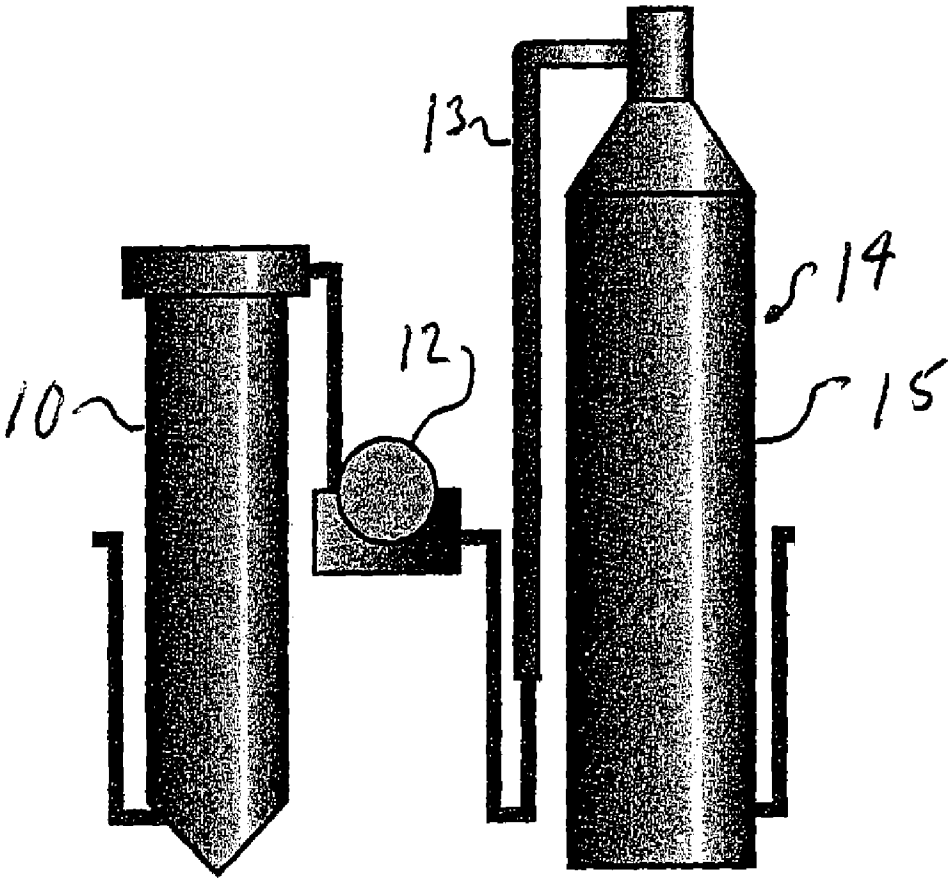
FIG. 1 is diagram of an extraction stage and a chlorine dioxide stage of a standard pulp mill.

In Applicant's copending U.S. patent application Ser. No. 09/875,177 filed Jun. 6, 2001, which is incorporated herein by reference in its entirety, the use of chlorine dioxide is disclosed as a secondary oxidant for use with a hindered cyclic oxammonium salt as the primary oxidant.

This application discusses the nitroxide, oxammonium salt, amine or hydroxylamine of a corresponding hindered heterocyclic amine compound. The oxammonium salt is the catalytically active form but this is an intermediate compound that is formed from a nitroxide, continuously used to become a hydroxylamine, and then regenerated, presumably back to the nitroxide. The secondary oxidant will convert the amine form to the free radical nitroxide compound. The term "nitroxide" is normally used for the compound in the literature. The secondary oxidant will also regenerate the oxammonium salt from the hydroxylamine.

The method described in the application is suitable for carboxylation of chemical fibrous cellulose pulp. This may be bleached sulfite, kraft, or pre-hydrolyzed kraft hardwood or softwood pulps or mixtures of hardwood or softwood pulps.

The cellulose fiber in an aqueous slurry or suspension is first oxidized by addition of a primary oxidizer comprising a cyclic oxammonium salt. This may conveniently be formed in situ from a corresponding amine, hydroxylamine or nitroxyl compound which lacks any α-hydrogen substitution on either of the carbon atoms adjacent the nitroxyl nitrogen atom. Substitution on these carbon atoms is preferably a one or two carbon alkyl group. For sake of convenience in description it will be assumed, unless otherwise noted, that a nitroxide is used as the primary oxidant and that term should be understood to include all of the precursors of the corresponding nitroxide or its oxammonium salt.

Nitroxides having both five and six membered rings have been found to be satisfactory. Both five and six membered rings may have either a methylene group or a heterocyclic atom selected from nitrogen, sulfur or oxygen at the four position in the ring, and both rings may have one or two substituent groups at this location.

A large group of nitroxide compounds have been found to be suitable. 2,2,6,6-tetramethylpiperidinyl-1-oxy free radical (TEMPO) is among the exemplary nitroxides found useful. Another suitable product linked in a mirror image relationship to TEMPO is 2,2,2',2',6,6,6',6'-octamethyl-4,4'-bipiperidinyl-1,1'-dioxy di-free radical (BITEMPO). Similarly, 2,2,6,6-tetramethyl-4-hydroxypipereidinyl-1-oxy free radical; 2,2,6,6-tetramethyl-4-methoxypiperidinyl-1-oxy free radical; and 2,2,6,6-tetramethyl-4-benzyloxypiperidinyl-1-oxy free radical; 2,2,6,6-tetramethyl-4-aminopiperidinyl-1-oxy free radical; 2,2,6,6-tetramethyl-4-acetylaminopiperidinyl-1-oxy free radical; 2,2,6,6-tetramethyl-4-piperidone-1-oxy free radical and ketals of this compound are examples of compounds with substitution at the 4 position of TEMPO that have been found to be very satisfactory oxidants. Among the nitroxides with a second hetero atom in the ring at the four position (relative to the nitrogen atom), 3,3,5,5-tetramethylmorpholine-1-oxy free radical (TEMMO) is useful.

The nitroxides are not limited to those with saturated rings. One compound anticipated to be a very effective oxidant is 3,4-dehydro-2,2,6,6-tetramethyl-piperidinyl-1-oxy free radical.

Six membered ring compounds with double substitution at the four position have been especially useful because of their relative ease of synthesis and lower cost. Exemplary among these are the 1,2-ethanediol, 1,2-propanediol, 2,2-dimethyl-1-3-propanediol (1,3-neopentyldiol) and glyceryl cyclic ketals of 2,2,6,6-tetramethyl-4-piperidone-1-oxy free radical.

Among the five membered ring products, 2,2,5,5-tetramethyl-pyrrolidinyl-1-oxy free radical is anticipated to be very effective.

The following groups of nitroxyl compounds and their corresponding amines or hydroxylamines are known to be effective primary oxidants:

I

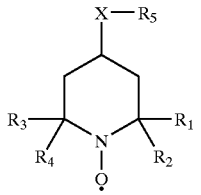

in which $R_1$–$R_4$ are one to four carbon alkyl groups but $R_1$ with $R_2$ and $R_3$ with $R_4$ may together be included in a five or six carbon alicyclic ring structure; X is sulfur or oxygen; and $R_5$ is hydrogen, $C_1$–$C_{12}$ alkyl, benzyl, 2-dioxanyl, a dialkyl ether, an alkyl polyether, or a hydroxyalkyl, and X with $R_5$ being absent may be hydrogen or a mirror image moiety to form a bipiperidinyl nitroxide. Specific compounds in this group known to be very effective are 2,2,6,6-tetramethylpiperidinyl-1-oxy free radical (TEMPO); 2,2,2',2',6,6,6',6'-octamethyl-4,4'-bipiperidinyl-1,1'-dioxy di-free radical (BI-TEMPO); 2,2,6,6-tetramethyl-4-hydroxypiperidinyl-1-oxy free radical (4-hydroxy TEMPO); 2,2,6,6-tetramethyl-4-methoxypiperidinyl-1-oxy free radical (4-methoxy-TEMPO); and 2,2,6,6-tetramethyl-4-benzyloxypiperidinyl-1-oxy free radical (4-benzyloxy-TEMPO).

II

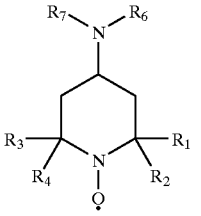

in which $R_1$–$R_4$ are one to four carbon alkyl groups but $R_1$ with $R_2$ and $R_3$ with $R_4$ may together be included in a five or six carbon alicyclic ring structure; $R_6$ is hydrogen, $C_1$–$C_5$ alkyl, $R_7$ is hydrogen, $C_1$–$C_8$ alkyl, phenyl, carbamoyl, alkyl carbamoyl, phenyl carbamoyl, or $C_1$–$C_8$ acyl. Exemplary of this group is 2,2,6,6-tetramethyl-4-aminopiperidinyl-1-oxy free radical (4-amino TEMPO); and 2,2,6,6-tetramethyl-4-acetylaminopipdereidinyl-1-oxy free radical (4-acetylamino-TEMPO).

III

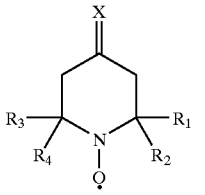

in which $R_1$–$R_4$ are one to four carbon alkyl groups but $R_1$ with $R_2$ and $R_3$ with $R_4$ may together be included in a five or six carbon alicyclic ring structure; and X is oxygen, sulfur, NH, N-alkyl, NOH, or NO $R_8$ where $R_8$ is lower alkyl. An example might be 2,2,6,6-tetramethyl-4-oxopiperidinyl-1-oxy free radical (2,2,6,6-tetramethyl-4-piperidone-1-oxy free radical).

IV

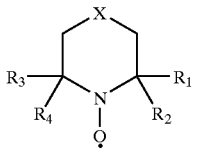

wherein $R_1$–$R_4$ are one to four carbon alkyl groups but $R_1$ with $R_2$ and $R_3$ with $R_4$ may be linked into a five or six carbon alicyclic ring structure; and X is oxygen, sulfur, -alkyl amino, or acyl amino. An example is 3,3,5,5-tetramethylmorpholine-4-oxy free radical. In this case the oxygen atom takes precedence for numbering but the dimethyl substituted carbons remain adjacent the nitroxide moiety.

V

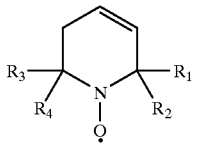

wherein $R_1$–$R_4$ are one to four carbon alkyl groups but $R_1$ with $R_2$ and $R_3$ with $R_4$ may be linked into a five or six carbon alicyclic ring structure. An example of a suitable compound is 3,4-dehydro-2,2,6,6-tetramethylpiperidinyl-1-oxy free radical.

VI

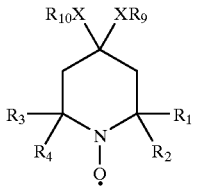

wherein $R_1$–$R_4$ are one to four carbon alkyl groups but $R_1$ with $R_2$ and $R_3$ with $R_4$ may together be included in a five or six carbon alicyclic ring structure; X is methylene, oxygen, sulfur, or alkylamino; and $R_9$ and $R_{10}$ are one to five carbon alkyl groups and may together be included in a five or six member ring structure, which in turn may have one to four lower alkyl or hydroxy alkyl substitutients. Examples include the 1,2-ethanediol; 1,3-propanediol,2,2-dimethyl-1,3-propanediol, and glyceryl cyclic ketals of 2,2,6,6-tetramethyl-4-piperidone-1-oxy free radical. These compounds are especially preferred primary oxidants because of their effectiveness, lower cost, ease of synthesis, and suitable water solubility.

VII

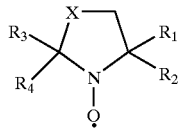

in which $R_1$–$R_4$ are one to four carbon alkyl groups but $R_1$ with $R_2$ and $R_3$ with $R_4$ may together be included in a five or six carbon alicyclic ring structure; X may be methylene, sulfur, oxygen, —NH, or $NR_{11}$, in which $R_{11}$ is a lower alkyl. An example of these five member ring compounds is 2,2,5,5-tetramethylpyrrolidinyl-1-oxy free radical.

Where the term "lower alkyl" is used it should be understood to mean an aliphatic straight or branched chain alky moiety having from one to four carbon atoms.

The above named compounds should only be considered as exemplary among the many representatives of the nitroxides suitable for use with the invention and those named are not intended to be limited in any way.

During the oxidation reaction the nitroxide is consumed and converted to an oxammonium salt then to a hydroxylamine. Evidence indicates that the nitroxide is continuously regenerated by the presence of a secondary oxidant. Chlorine dioxide, or a latent source, is a preferred secondary oxidant. Since the nitroxide is not irreversibly consumed in the oxidation reaction only a catalytic amount of it is required. During the course of the reaction it is the secondary oxidant which will be depleted.

The amount of nitroxide required is in the range of about 0.0005% to 1.0% by weight based on carbohydrate present, preferably about 0.005–0.25%. The nitroxide is known to preferentially oxidize the primary hydroxyl which is located on C-6 of the anhydroglucose moiety in the case of cellulose or starches. It can be assumed that a similar oxidation will occur at primary alcohol groups on hemicellulose or other carbohydrates having primary alcohol groups.

The chlorine dioxide secondary oxidant is present in an amount of 0.2–35% by weight of the carbohydrate being oxidized, preferably about 0.5–10% by weight.

Abundant laboratory data indicates that a nitroxide catalyzed cellulose oxidation predominantly occurs at the primary hydroxyl group on C-6 of the anhydroglucose moiety. In contrast to some of the other routes to oxidized cellulose, only very minor reaction has been observed to occur at the secondary hydroxyl groups at the C-2 and C-3 locations. Using TEMPO as an example, the mechanism to formation of a carboxyl group at the C-6 location proceeds through an intermediate aldehyde stage.

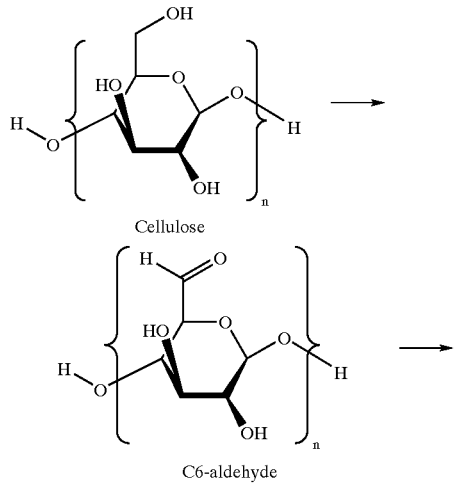

-continued

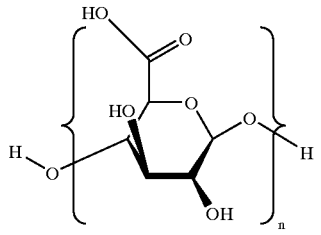

The TEMPO is not irreversibly consumed in the reaction but is continuously regenerated. It is converted by the secondary oxidant into the oxammonium (or nitrosonium) ion which is the actual oxidant. During oxidation the oxammonium ion is reduced to the hydroxylamine from which TEMPO is again formed. Thus, it is the secondary oxidant which is actually consumed. TEMPO may be reclaimed or recycled from the aqueous system. The reaction is postulated to be as follows: nitrosonium) ion which is the actual oxidant. During oxidation the oxammonium ion is reduced to the hydroxylamine from which TEMPO is again formed. Thus, it is the secondary oxidant which is actually consumed. TEMPO may be reclaimed or recycled from the aqueous system. The reaction is postulated to be as follows:

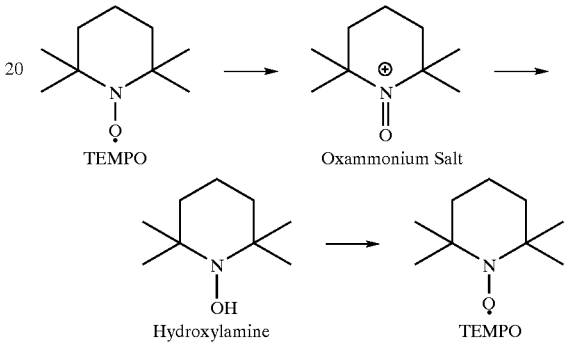

The resulting oxidized cellulose product will have a mixture of carboxyl and aldehyde substitution. Aldehyde substituents on cellulose are known to cause degeneration over time and under certain environmental conditions. In addition, minor quantities of ketone carbonyls may be formed at the C-2 and C-3 positions of the anhydroglucose units and these will also lead to degradation. Marked D.P., fiber strength loss, crosslinking, and yellowing are among the problems encountered. For these reasons it is desirable to oxidize aldehyde substituents to carboxyl groups, or to reduce aldehyde and ketone groups to hydroxyl groups, to ensure stability of the product.

To achieve maximum stability and D.P. retention the oxidized product may be treated with a stabilizing agent to convert any substituent groups, such as aldehydes or ketones, to hydroxyl or carboxyl groups. The stabilizing agent may either be another oxidizing agent or a reducing agent. Unstabilized oxidized cellulose pulps have objectionable color reversion and may self crosslink upon drying, thereby reducing their ability to redisperse and form strong bonds when used in sheeted products. It has been found that acidifying the initial reaction mixture to the pH range given for chlorites without without draining or washing the product is often sufficient to convert the aldehyde moieties to carboxyl functions. Peroxide and acid is also a desirable stabilizing mixture under the conditions shown for chlorite. Otherwise one of the following oxidation treatments may be used. Alkali methyl chlorites are one class of oxidizing agents used as stabilizers, sodium chlorite being preferred because of the cost factor. Other compounds that may serve equally well as oxidizers are permanganates, chromic acid, bromine, silver oxide, and peracids. A combination of chlorine dioxide and hydrogen peroxide is also a suitable oxidizer when used at the pH range designated for sodium chlorite. Oxidation using sodium chlorite may be carried out at a pH in the range of about 0–5, preferably 2–4, at temperatures between about 10°–110° C., preferably about 20°–95° C., for times from about 0.5 minutes to 50 hours, preferably about 10 minutes to 2 hours. One factor that favors oxidants as opposed to reducing agents is that aldehyde groups on the oxidized carbohydrate are converted to additional carboxyl groups, thus resulting in a more highly carboxylated product. These oxidants are referred to as "tertiary oxidizers" to distinguish them from the nitroxide/chlorine dioxide primary/secondary oxidizers. The tertiary oxidizer is used in a molar ratio of about 1.0–15 times the presumed aldehyde content of the oxidized carbohydrate, preferably about 5–10 times. In a more convenient way of measuring the needed tertiary oxidizer, the preferred sodium chlorite usage should fall within about 0.01–20% based on carbohydrate, preferably about 1–9% by weight based on carbohydrate, the chlorite being calculated on a 100% active material basis.

When stabilizing with a chlorine dioxide and hydrogen peroxide mixture, the concentration of chlorine dioxide present should be in a range of about 0.01–20% by weight of carbohydrate, preferably about 0.3–1.0%, and concentration of hydrogen peroxide should fall within the range of about 0.01–10% by weight of carbohydrate, preferably 0.05–1.0%. Time will generally fall within the range of 0.5 minutes to 50 hours, preferably about 10 minutes to 2 hours and temperature within the range of about 10°–110° C., preferably about 30°–95° C. The pH of the system is preferably about 3 but may be in the range of 0–5.

In Applicant's copending U.S. patent application Ser. No. 10/635,284, pub. number US2005/0028953, filed contemporaneously herewith, which also is incorporated herein by reference in its entirety, the use of chlorine dioxide is a secondary oxidant for use with N-halo hindered cyclic amine compounds as the primary oxidant. The N-halo hindered cyclic amine compounds are as effective as TEMPO and other related nitroxides in methods for making carboxylated cellulose fibers.

The N-halo hindered cyclic amine compounds are fully alkylated at the carbon atoms adjacent to the amino nitrogen atom (i.e., the N—Cl or N—Br) and have from 4 to 8 atoms in the ring. In one embodiment, the N-halo hindered cyclic amine compounds are six-membered ring compounds. In another embodiment, the N-halo hindered cyclic amine compounds are five-membered ring compounds.

Representative N-halo hindered cyclic amine compounds useful in the method of the invention for making carboxylated cellulose pulp fibers include Structures (I)–(VII).

Structure (I):

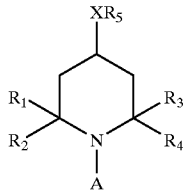

For Structure (I), $R_1$–$R_4$ can be C1–C6 straight-chain or branched alkyl groups, for example, methyl, ethyl, propyl, butyl, pentyl, or hexyl groups. Alternatively, $R_1$ and $R_2$ taken together can form a five- or six-carbon cycloalkyl group, and $R_3$ and $R_4$ taken together can form a five- or six-carbon cycloalkyl group. The cycloalkyl group can be further substituted with, for example, one or more C1–C6 alkyl groups or other substituents. X can be sulfur or oxygen. $R_5$ can be hydrogen, C1–C12 straight-chain or branched alkyl or alkoxy, aryl, aryloxy, benzyl, 2-dioxanyl, dialkyl ether, alkyl polyether, or hydroxyalkyl group. Alternatively, $R_5$ can be absent and X can be hydrogen or a mirror image moiety to form a bipiperidinyl compound. A is a halogen, for example, chloro or bromo. Representative compounds of Structure (I) include N-halo-2,2,6,6-tetramethylpiperidine; N,N'-dihalo-2,2,2',2',6,6,6',6-octamethyl-4,4'-bipiperidine; N-halo-2,2,6,6-tetramethyl-4-hydroxypiperidine; N-halo-2,2,6,6-tetramethyl-4-methoxypiperidine; and N-halo-2,2,6,6-tetramethyl-4-benzyloxypiperidine.

Structure (II):

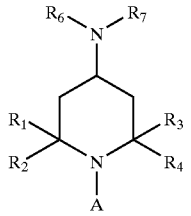

For Structure (II), $R_1$–$R_4$ can be C1–C6 straight-chain or branched alkyl groups, for example, methyl, ethyl, propyl, butyl, pentyl, or hexyl groups. Alternatively, $R_1$ and $R_2$ taken together can form a five- or six-carbon cycloalkyl group, and $R_3$ and $R_4$ taken together can form a five- or six-carbon cycloalkyl group. The cycloalkyl group can be further substituted with, for example, one or more C1–C6 alkyl groups or other substituents. X can be oxygen or sulfur. $R_6$ can be hydrogen, C1–C6 straight-chain or branched alkyl groups. $R_7$ can be hydrogen, C1–C8 straight-chain or branched alkyl groups, phenyl, carbamoyl, alkyl carbamoyl, phenyl carbamoyl, or C1–C8 acyl. A is a halogen, for example, chloro or bromo. Representative compounds of Structure (II) include N-halo-2,2,6,6-tetramethyl-4-aminopiperidine and N-halo-2,2,6,6-tetramethyl-4-acetylaminopiperidine.

Structure (III):

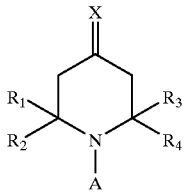

For Structure (III), $R_1$–$R_4$ can be C1–C6 straight-chain or branched alkyl groups, for example, methyl, ethyl, propyl, butyl, pentyl, or hexyl groups. Alternatively, $R_1$ and $R_2$ taken together can form a five- or six-carbon cycloalkyl group, and $R_3$ and $R_4$ taken together can form a five- or six-carbon cycloalkyl group. The cycloalkyl group can be further substituted with, for example, one or more C1–C6 alkyl groups or other substituents. X can be oxygen, sulfur, NH, alkylamino (i.e., NH-alkyl), dialkylamino, NOH, or $NOR_{10}$, where $R_{10}$ is a C1–C6 straight-chain or branched alkyl group. A is a halogen, for example, chloro or bromo. A representative compound of Structure (III) is N-halo-2,2,6,6-tetramethylpiperidin-4-one.

Structure (IV):

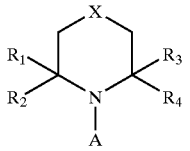

For Structure (IV), $R_1$–$R_4$ can be C1–C6 straight-chain or branched alkyl groups, for example, methyl, ethyl, propyl, butyl, pentyl, or hexyl groups. Alternatively, $R_1$ and $R_2$ taken together can form a five- or six-carbon cycloalkyl group, and $R_3$ and $R_4$ taken together can form a five- or six-carbon cycloalkyl group. The cycloalkyl group can be further substituted with, for example, one or more C1–C6 alkyl groups or other substituents. X can be oxygen, sulfur, alkylamino (i.e., N—$R_{10}$), or acylamino (i.e., N—C(═O)—$R_{10}$), where $R_{10}$ is a C1–C6 straight-chain or branched alkyl group. A is a halogen, for example, chloro or bromo. A representative compound of Structure (IV) is N-halo-3,3,5,5-tetramethylmorpholine.

Structure (V):

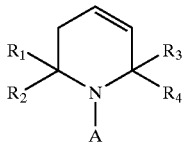

For Structure (V), $R_1$–$R_4$ can be C1–C6 straight-chain or branched alkyl groups, for example, methyl, ethyl, propyl, butyl, pentyl, or hexyl groups. Alternatively, $R_1$ and $R_2$ taken together can form a five- or six-carbon cycloalkyl group, and $R_3$ and $R_4$ taken together can form a five- or six-carbon cycloalkyl group. The cycloalkyl group can be further substituted with, for example, one or more C1–C6 alkyl groups or other substituents. A is a halogen, for example, chloro or bromo. A representative compound of Structure (V) is N-halo-3,4-dehydro-2,2,6,6,-tetramethylpiperidine.

Structure (VI):

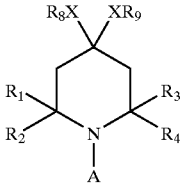

For Structure (VI), $R_1$–$R_4$ can be C1–C6 straight-chain or branched alkyl groups, for example, methyl, ethyl, propyl, butyl, pentyl, or hexyl groups. Alternatively, $R_1$ and $R_2$ taken together can form a five- or six-carbon cycloalkyl group, and $R_3$ and $R_4$ taken together can form a five- or six-carbon cycloalkyl group. The cycloalkyl group can be further substituted with, for example, one or more C1–C6 alkyl groups or other substituents. X can be methylene (i.e., $CH_2$), oxygen, sulfur, or alkylamino. $R_8$ and $R_9$ can be independently selected from C1–C6 straight-chain or branched alkyl groups, for example, methyl, ethyl, propyl, butyl, pentyl, or hexyl groups. Alternatively, $R_8$ and $R_9$ taken together can form a five- or six-membered ring, which can be further substituted with, for example, one or more C1–C6 alkyl groups or other substituents. A is a halogen, for example, chloro or bromo. Representative compounds of Structure (VI) include N-halo-4-piperidone ketals, such as ethylene, propylene, glyceryl, and neopentyl ketals. Representative compounds of Structure (VI) include N-halo-2,2,6,6-tetramethyl-4-piperidone ethylene ketal, N-halo-2,2,6,6-tetramethyl-4-piperidone propylene ketal, N-halo-2,2,6,6-tetramethyl-4-piperidone glyceryl ketal, and N-halo-2,2,6,6-tetramethyl-4-piperidone neopentyl ketal.

Structure (VII):

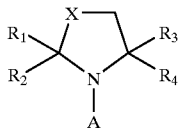

For Structure (VII), $R_1$–$R_4$ can be C1–C6 straight-chain or branched alkyl groups, for example, methyl, ethyl, propyl, butyl, pentyl, or hexyl groups. Alternatively, $R_1$ and $R_2$ taken together can form a five- or six-carbon cycloalkyl group, and $R_3$ and $R_4$ taken together can form a five- or six-carbon cycloalkyl group. The cycloalkyl group can be further substituted with, for example, one or more C1–C6 alkyl groups or other substituents. X can be methylene, oxygen, sulfur, NH, (i.e., N—$R_{10}$), or acylamino (i.e., N—C(═O)—$R_{10}$), where $R_{10}$ is a C1–C6 straight-chain or branched alkyl group. A is a halogen, for example, chloro or bromo. A representative compound of Structure (VII) is N-halo-2,2,5,5-tetramethylpyrrolidine.

In general, the N-halo hindered cyclic amine compounds noted above can be prepared by chlorination or bromination of the corresponding amine compounds.

Carboxylated cellulose pulp fibers can be made using hindered cyclic amine compounds or N-halo hindered cyclic amine compound in aqueous media under heterogeneous conditions. In the method, the hindered cyclic amine compound or the N-halo hindered cyclic amine compound reacts with a secondary oxidizing agent (e.g., chlorine dioxide, peracids, hypochlorites, chlorites, ozone, hydrogen peroxide, potassium superoxide) to provide a primary oxidizing agent that reacts with cellulose pulp fibers to provide cellulose pulp fibers containing both carboxyl and aldehyde functional groups. In one embodiment, the cellulosic fibers containing carboxyl and aldehyde functional groups are further treated to provide stable carboxylated cellulosic fibers. In the method, under basic pH conditions and in the presence of a secondary oxidizing agent, the primary oxidizing agent is generated from the hindered cyclic amine compound or the N-halo hindered cyclic amine compound. In one embodiment, the cellulosic fibers containing both carboxyl and aldehyde functional groups obtained at the end of the first stage of the carboxylation process are further treated to provide stable carboxylated cellulosic fibers.

As noted above, in one embodiment, the method for making carboxylated cellulose pulp fibers includes two steps: (1) a first stage of carboxylation; and (2) a stabilization step in which any remaining aldehyde groups are converted to carboxyl groups providing a stable pulp.

In the first stage of carboxylation, cellulose pulp fibers are oxidized (i.e.,oxidized to aldehyde and carboxyl functional groups) under basic pH conditions and in the presence of a secondary oxidizing agent, such as chlorine dioxide, hypochlorite, peracids, or certain metal ions, with a catalytically active species (e.g., an oxammonium ion) generated from a N-halo hindered cyclic amine compound described above.

The first stage of the carboxylation process generally takes place at a temperature from about 20° C. to about 90° C. The hindered cyclic amine compound or the N-halo hindered cyclic amine compound is present in an amount from about 0.002% to about 0.25% by weight based on the total weight of the pulp. The secondary oxidizing agent is present in an amount from about 0.1 to about 10% by weight based on the total weight of the pulp. Reaction times for the first stage of carboxylating the pulp range from about 5 seconds to about 10 hours, depending upon reaction temperature and the amount of hindered cyclic amine compound or N-halo hindered cyclic amine compound and secondary oxidizing agent.

Chlorine dioxide is a suitable secondary oxidizing agent. The pH during oxidation should generally be maintained within the range of about 6.0 to 11, preferably about 6.0 to 10, and most preferably about 6.25 to 9.0. The oxidation reaction will proceed at higher and lower pH values, but at lower efficiencies.

A study was conducted to determine effects of time and chemical loadings on the carboxyl content and viscosity of the pulp. The study was conducted at 50° C. and 70° C.

In each set of studies, water sufficient to achieve a final pulp consistency of 7.5% was placed in a Quantum mixer. The water was heated to the desired temperature (50° C. or 70° C.). Sodium hydroxide was added to the water in the amounts shown in Tables 2 and 3. 32.1% never-dried partially bleached softwood pulp from the Weyerhaeuser Prince Albert SK mill was added to the water. The pulp was taken from the E2 bleach stage. It weighed 150 g. on an oven-dry basis. The sample was quickly mixed at 100% power.

2.25 grams of 2% EGK-TAA (ethylene glycol ketal of triacetonamine) was added to a chlorine dioxide solution. The amount of EGK-TAA was 0.03 weight % of the dry oven dry weight of the pulp. The amount of chlorine dioxide was varied as shown in the Tables 2 through 5.

The EGK-TAA/chlorine dioxide mixture was injected into the mixer while it was being stirred. Time 0 is the time that the injection of the mixture started.

At the end of the reaction time the stabilizing mixture was pressure injected into the pulp to quench the stage 1 oxidation and start the stage 2 stabilization. The pulp was stabilized with 0.5% HOOH and 3.9% sulfuric acid (pH<4) for 1 hours. The pH was not measured, but based on earlier experience the pH would have been below 4 and was probably between 2 and 3. There was a yellow color indicating the regeneration of chlorine dioxide by the reaction of chlorite with aldehyde groups which also indicated that the pH was below 4. Each sample was stabilized for about 1 hour. The stabilization temperature was targeted to be either 50° C. or 70° C. All samples were washed with DI water, treated with NaOH to convert the carboxylic acid groups on the pulp to the sodium salt form and washed. The samples were analyzed for carboxyl, viscosity, brightness and brightness reversion.

The control was the uncarboxylated pulp. The carboxyl content, viscosity, brightness and brightness reversion are shown in table 1.

TABLE 1

| Example | Carboxyl meq/100 g | Visc mPa * s | Brightness ISO | Brightness Reversion |
|---|---|---|---|---|
| 1 | 4.61 | 33.0 | 85.37 | 84.17 |

The results of the 70° C. tests are shown in Table 2 and the results of the 50° C. tests are shown in Table 3. The results of the 70° C. and 50° C. tests are listed by carboxyl content in Tables 4 and 5, respectively.

TABLE 2

| Ex. | Time sec | $ClO_2$ wt. % | NaOH wt % | Ratio $ClO_2$:NaOH | Carboxyl meq/100 g | Visc mPa * s | Brightness ISO | Brightness Reversion |
|---|---|---|---|---|---|---|---|---|
| 2 | 5 | 1.0 | 0.70 | 0.70 | 7.14 | 28.0 | 91.07 | 89.61 |
| 3 | 5 | 1.0 | 1.00 | 1.00 | 7.56 | 24.5 | 91.74 | 90.37 |
| 4 | 15 | 1.0 | 0.85 | 0.85 | 7.85 | 25.4 | 91.90 | 90.45 |
| 5 | 25 | 1.0 | 0.70 | 0.70 | 8.02 | 25.8 | 91.23 | 89.32 |
| 6 | 25 | 1.0 | 1.00 | 1.00 | 6.88 | 19.4 | 91.39 | 89.80 |
| 7 | 5 | 1.2 | 1.02 | 0.85 | 8.35 | 24.1 | 91.48 | 89.99 |
| 8 | 15 | 1.2 | 0.84 | 0.70 | 8.53 | 24.8 | 91.56 | 90.26 |
| 9 | 15 | 1.2 | 1.02 | 0.85 | 7.74 | 20.3 | 91.55 | 90.20 |
| 10 | 15 | 1.2 | 1.02 | 0.85 | 8.11 | 20.0 | 92.14 | 90.56 |
| 11 | 15 | 1.2 | 1.02 | 0.85 | 8.21 | 20.2 | 91.93 | 90.61 |

TABLE 2-continued

| Ex. | Time sec | $ClO_2$ wt. % | NaOH wt % | Ratio $ClO_2$:NaOH | Carboxyl meq/100 g | Visc mPa * s | Brightness ISO | Brightness Reversion |
|---|---|---|---|---|---|---|---|---|
| 12 | 15 | 1.2 | 1.20 | 1.00 | 7.59 | 19.4 | 91.64 | 90.19 |
| 13 | 25 | 1.2 | 1.02 | 0.85 | 7.32 | 18.9 | 91.19 | 89.73 |
| 14 | 5 | 1.4 | 1.40 | 1.00 | 7.81 | 21.6 | 91.73 | 90.38 |
| 15 | 5 | 1.4 | 0.98 | 0.70 | 8.71 | 24.1 | 92.00 | 90.79 |
| 16 | 15 | 1.4 | 1.19 | 0.85 | 8.77 | 19.4 | 92.07 | 90.65 |
| 17 | 25 | 1.4 | 0.98 | 0.70 | 9.23 | 24.8 | 91.61 | 90.06 |
| 18 | 25 | 1.4 | 1.40 | 1.00 | 8.23 | 17.5 | 92.22 | 90.69 |

TABLE 3

| Ex. | Time sec | $ClO_2$ wt. % | NaOH wt % | Ratio $ClO_2$:NaOH | Carboxyl meq/100 g | Visc mPa * s | Brightness ISO | Brightness Reversion |
|---|---|---|---|---|---|---|---|---|
| 20 | 5 | 1.0 | 0.70 | 0.70 | 7.58 | 29.0 | 91.66 | 90.18 |
| 19 | 5 | 1.0 | 1.00 | 1.00 | 7.12 | 26.0 | 91.81 | 90.34 |
| 21 | 15 | 1.0 | 0.85 | 0.85 | 6.82 | 24.8 | 92.08 | 90.49 |
| 23 | 25 | 1.0 | 0.70 | 0.70 | 7.71 | 27.3 | 90.87 | 89.00 |
| 22 | 25 | 1.0 | 1.00 | 1.00 | 6.74 | 21.7 | 92.14 | 90.71 |
| 24 | 5 | 1.2 | 1.02 | 0.85 | 7.90 | 26.0 | 92.18 | 90.45 |
| 28 | 15 | 1.2 | 0.84 | 0.70 | 8.60 | 27.9 | 90.91 | 89.50 |
| 26 | 15 | 1.2 | 1.02 | 0.85 | 7.58 | 22.8 | 91.88 | 90.35 |
| 27 | 15 | 1.2 | 1.02 | 0.85 | 8.14 | 24.9 | 91.81 | 90.32 |
| 29 | 15 | 1.2 | 1.02 | 0.85 | 8.54 | 25.1 | 92.13 | 90.76 |
| 30 | 25 | 1.2 | 1.02 | 0.85 | 8.21 | 24.4 | 92.16 | 90.69 |
| 25 | 15 | 1.2 | 1.20 | 1.00 | 6.96 | 24.2 | 92.52 | 91.00 |
| 32 | 5 | 1.4 | 0.98 | 0.70 | 8.83 | 26.0 | 92.19 | 90.63 |
| 31 | 5 | 1.4 | 1.40 | 1.00 | 7.85 | 23.4 | 92.90 | 91.42 |
| 33 | 15 | 1.4 | 1.19 | 0.85 | 8.63 | 23.6 | 91.87 | 90.13 |
| 34 | 25 | 1.4 | 0.98 | 0.70 | 9.34 | 27.9 | 91.77 | 90.29 |
| 35 | 25 | 1.4 | 1.40 | 1.00 | 8.03 | 19.8 | 92.41 | 90.79 |

TABLE 4

| Ex. | Time sec | $ClO_2$ wt. % | NaOH wt % | Ratio $ClO_2$:NaOH | Carboxyl meq/100 g | Visc mPa * s | Brightness ISO | Brightness Reversion |
|---|---|---|---|---|---|---|---|---|
| 6 | 25 | 1.0 | 1.00 | 1.00 | 6.88 | 19.4 | 91.39 | 89.80 |
| 2 | 5 | 1.0 | 0.70 | 0.70 | 7.14 | 28.0 | 91.07 | 89.61 |
| 13 | 25 | 1.2 | 1.02 | 0.85 | 7.32 | 18.9 | 91.19 | 89.73 |
| 3 | 5 | 1.0 | 1.00 | 1.00 | 7.56 | 24.5 | 91.74 | 90.37 |
| 12 | 15 | 1.2 | 1.20 | 1.00 | 7.59 | 19.4 | 91.64 | 90.19 |
| 9 | 15 | 1.2 | 1.02 | 0.85 | 7.74 | 20.3 | 91.55 | 90.20 |
| 14 | 5 | 1.4 | 1.40 | 1.00 | 7.81 | 21.6 | 91.73 | 90.38 |
| 4 | 15 | 1.0 | 0.85 | 0.85 | 7.85 | 25.4 | 91.90 | 90.45 |
| 5 | 25 | 1.0 | 0.70 | 0.70 | 8.02 | 25.8 | 91.23 | 89.32 |
| 7 | 5 | 1.2 | 1.02 | 0.85 | 8.35 | 24.1 | 91.48 | 89.99 |
| 10 | 15 | 1.2 | 1.02 | 0.85 | 8.11 | 20.0 | 92.14 | 90.56 |
| 11 | 15 | 1.2 | 1.02 | 0.85 | 8.21 | 20.2 | 91.93 | 90.61 |
| 18 | 25 | 1.4 | 1.40 | 1.00 | 8.23 | 17.5 | 92.22 | 90.69 |
| 8 | 15 | 1.2 | 0.84 | 0.70 | 8.53 | 24.8 | 91.56 | 90.26 |
| 15 | 5 | 1.4 | 0.98 | 0.70 | 8.71 | 24.1 | 92.00 | 90.79 |
| 16 | 15 | 1.4 | 1.19 | 0.85 | 8.77 | 19.4 | 92.07 | 90.65 |
| 17 | 25 | 1.4 | 0.98 | 0.70 | 9.23 | 24.8 | 91.61 | 90.06 |

TABLE 5

| Ex. | Time sec | $ClO_2$ wt. % | NaOH wt % | Ratio $ClO_2$:NaOH | Carboxyl meq/100 g | Visc mPa * s | Brightness ISO | Brightness Reversion |
|---|---|---|---|---|---|---|---|---|
| 22 | 25 | 1.0 | 1.00 | 1.00 | 6.74 | 21.7 | 92.14 | 90.71 |
| 21 | 15 | 1.0 | 0.85 | 0.85 | 6.82 | 24.8 | 92.08 | 90.49 |
| 25 | 15 | 1.2 | 1.20 | 1.00 | 6.96 | 24.2 | 92.52 | 91.00 |
| 19 | 5 | 1.0 | 1.00 | 1.00 | 7.12 | 26.0 | 91.81 | 90.34 |
| 20 | 5 | 1.0 | 0.70 | 0.70 | 7.58 | 29.0 | 91.66 | 90.18 |
| 26 | 15 | 1.2 | 1.02 | 0.85 | 7.58 | 22.8 | 91.88 | 90.35 |
| 23 | 25 | 1.0 | 0.70 | 0.70 | 7.71 | 27.3 | 90.87 | 89.00 |
| 31 | 5 | 1.4 | 1.40 | 1.00 | 7.85 | 23.4 | 92.90 | 91.42 |
| 24 | 5 | 1.2 | 1.02 | 0.85 | 7.90 | 26.0 | 92.18 | 90.45 |
| 35 | 25 | 1.4 | 1.40 | 1.00 | 8.03 | 19.8 | 92.41 | 90.79 |

TABLE 5-continued

| Ex. | Time sec | $ClO_2$ wt. % | NaOH wt % | Ratio $ClO_2$:NaOH | Carboxyl meq/100 g | Visc mPa * s | Brightness ISO | Brightness Reversion |
|---|---|---|---|---|---|---|---|---|
| 27 | 15 | 1.2 | 1.02 | 0.85 | 8.14 | 24.9 | 91.81 | 90.32 |
| 30 | 25 | 1.2 | 1.02 | 0.85 | 8.21 | 24.4 | 92.16 | 90.69 |
| 29 | 15 | 1.2 | 1.02 | 0.85 | 8.54 | 25.1 | 92.13 | 90.76 |
| 28 | 15 | 1.2 | 0.84 | 0.70 | 8.60 | 27.9 | 90.91 | 89.50 |
| 33 | 15 | 1.4 | 1.19 | 0.85 | 8.63 | 23.6 | 91.87 | 90.13 |
| 32 | 5 | 1.4 | 0.98 | 0.70 | 8.83 | 26.0 | 92.19 | 90.63 |
| 34 | 25 | 1.4 | 0.98 | 0.70 | 9.34 | 27.9 | 91.77 | 90.29 |

Another set of studies was conducted to determine carboxylation at times of 15 seconds, 30 seconds, 60 seconds, 120 seconds, 180 seconds and 240 seconds.

EXAMPLE 35

Never-dried partially bleached softwood pulp collected after the E2 bleach stage of the Weyerhaeuser Prince Albert SK mill pulp having an oven dry weight of 60 g, and 9.2 g sodium carbonate was added to 310 g of DI water and the mixture was heated to 70° C. 98 mL of chlorine dioxide, 6.7 g/L, and 1.2 g of ethylene glycol ketal of triacetoneamine (EGK-TAA) were mixed and added to the pulp. The pulp was mixed rapidly by hand. Samples were taken at 15, 30, 60, 120, 180 and 240 seconds after the $ClO_2$/EGK-TAA solution first contacted the pulp. Each of the samples were placed in a solution of 0.5 g $NaBH_4$ in 100 mL of water and left overnight at room temperature with periodic stirring. The pulps were then tested for carboxyl content. The carboxyl content in meq/100 g were as follows: 15 seconds—6.7, 30 seconds—6.8, 60 seconds—7.2, 120 seconds—7.5, 180 seconds—7.55, 240 seconds—7.6.

EXAMPLE 36

Northern softwood partially bleached kraft pulp collected after the E2 stage of the Weyerhaeuser Prince Albert, SK pulp mill was dewatered to 25–30% solids with a screw press.

All percentages are weight percentages based on the oven dry weight of the pulp.

The pulp was slurried in water and fed to a twin roll press which delivered pulp at a predetermined constant rate of 3.0 kg/minute pulp solids at 8–9% consistency (weight of pulp/weight of water) to a pilot process. Just after the twin roll press, sodium hydroxide was sprayed on the pulp stream at a rate of 0.65%. The pulp slurry was then mixed and heated in a steam mixer and fed to a Seepex progressive cavity pump which provided pulp slurry flow through two high intensity mixers and an upflow tower. The upflow tower fed a downflow tower by gravity. Pulp product was mined from the bottom of the downflow tower, adjusted to pH 7–9 with sodium hydroxide and dewatered on a belt washer.

EGK-TAA was dissolved in water and metered into a chlorine dioxide line. The mixture was 0.03% EGK-TAA and 0.88% chlorine dioxide. This line was connected to the pulp slurry process pipe just before it entered the first high intensity mixer. The Chlorine dioxide/EGK-TAA mixture was injected into the flowing pulp slurry and immediately mixed in the first high intensity mixer. Just before the second high intensity mixer, a mixture of sulfuric acid (0.17%) and hydrogen peroxide (0.5%) was injected into the pulp slurry. The distance between the $1^{st}$ high intensity mixers and the injection of the sulfuric acid/hydrogen peroxide, and the speed of the pulp slurry will determine the reaction time for the first stage of the carboxylation of the pulp. This setup allowed times as short as 6 seconds, but was preferred to be 15–30 seconds. In this example the time was 6 seconds. The pulp immediately enters the $2^{nd}$ high intensity mixer and mixed again. The pulp slurry flowed into the upflow tower and spent approximately 30 minutes there before entering the downflow tower where it spent approximately an hour. It was then mined from the bottom of the downflow tower.

The temperature at the bottom of the upflow tower was maintained at 50° C. by adjustments to the steam flow to the steam mixer. The pH was monitored near the end of the retention pipe prior to the sulfuric acid/hydrogen peroxide injection and was maintained at 6.25–6.75 by minor adjustments to the sodium hydroxide addition level to the pulp after the twin wire press. The pH was monitored at the bottom of the upflow tower and was maintained at 3.5–4.0 by minor adjustments to the sulfuric acid flow.

The dewatered pulp product had a carboxyl level of 8.5 meq/100 g, an ISO brightness of 90.38% and a viscosity of 25.6 mPa-s.

It can be seen that short reaction times are possible and that it is possible to use existing equipment with little modification to carboxylate wood pulp.

FIG. 1 shows a standard extract stage and a chlorine dioxide stage of a pulp mill. Pulp, in slurry form, which has been bleached with a bleaching chemical such as chlorine, chlorine dioxide or hydrogen peroxide is treated with sodium hydroxide is extraction tower 10. Sodium hydroxide solubilizes the chemicals in the pulp that have reacted with the bleaching chemical. The pulp is carried to washer 12 in which the solubilized material is washed from the pulp.

The pulp slurry is moved from the washer 12 to the next stage by pump 18 (shown in FIGS. 2 and 3) and then mixed with chlorine dioxide in mixer 24 (shown in FIGS. 2 and 3) and flows into the upflow section 13 of chlorine dioxide tower 14. The pulp slurry then passes through the downflow section 15 of the tower 14 where it continues to react with the chlorine dioxide. The slurry then leaves the tower 14 and is washed in a washer 16 (shown in FIGS. 2 and 3).

The short reaction time of the first stage of the carboxylation process allows a simple modification to the standard extraction and chlorine dioxide stage to allow carboxylation and stabilization in these units.

Figure 2:
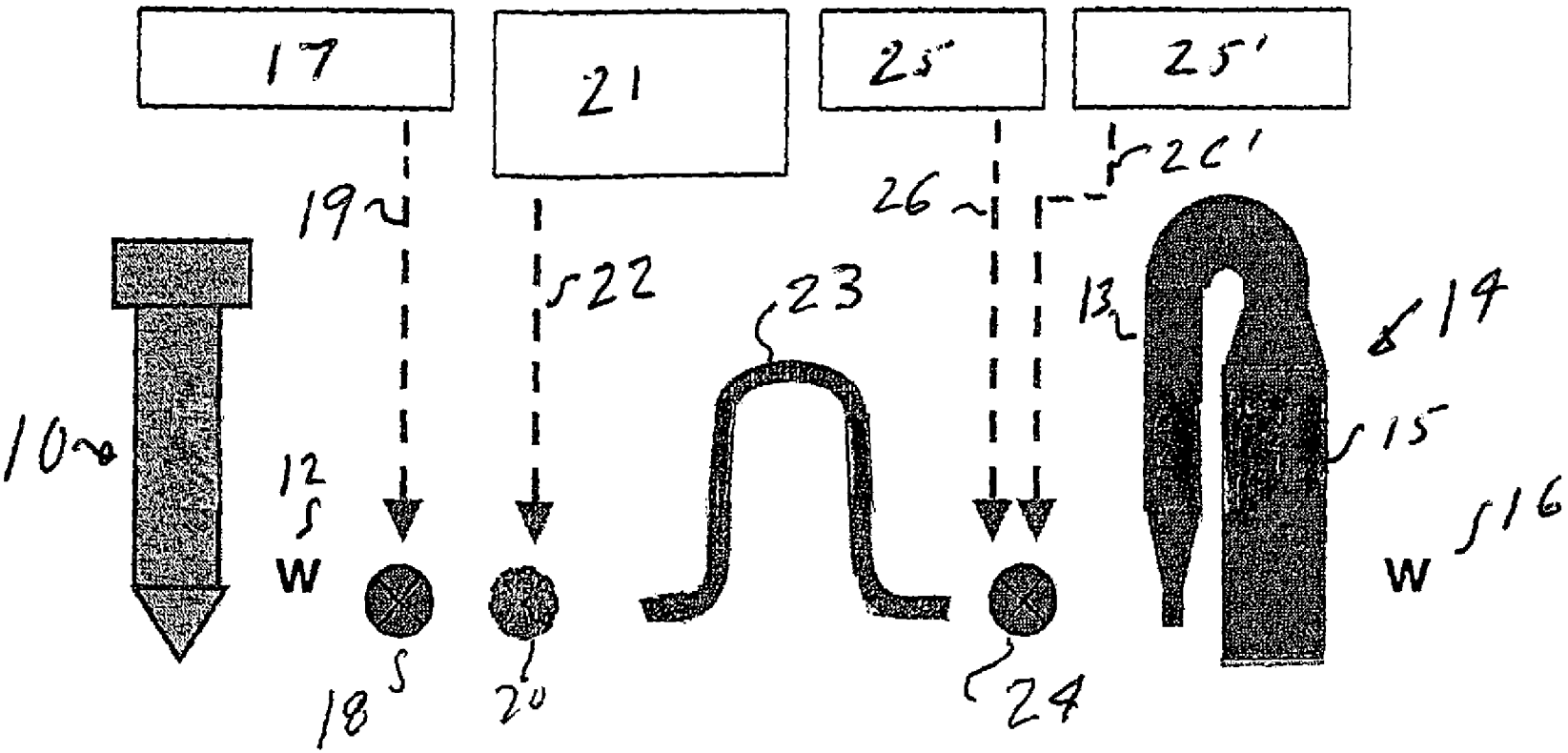
FIGS. 2 and 3 are diagrams of an extraction stage and a chlorine dioxide stage showing the changes to provide a carboxylation reaction.
Figure 3:
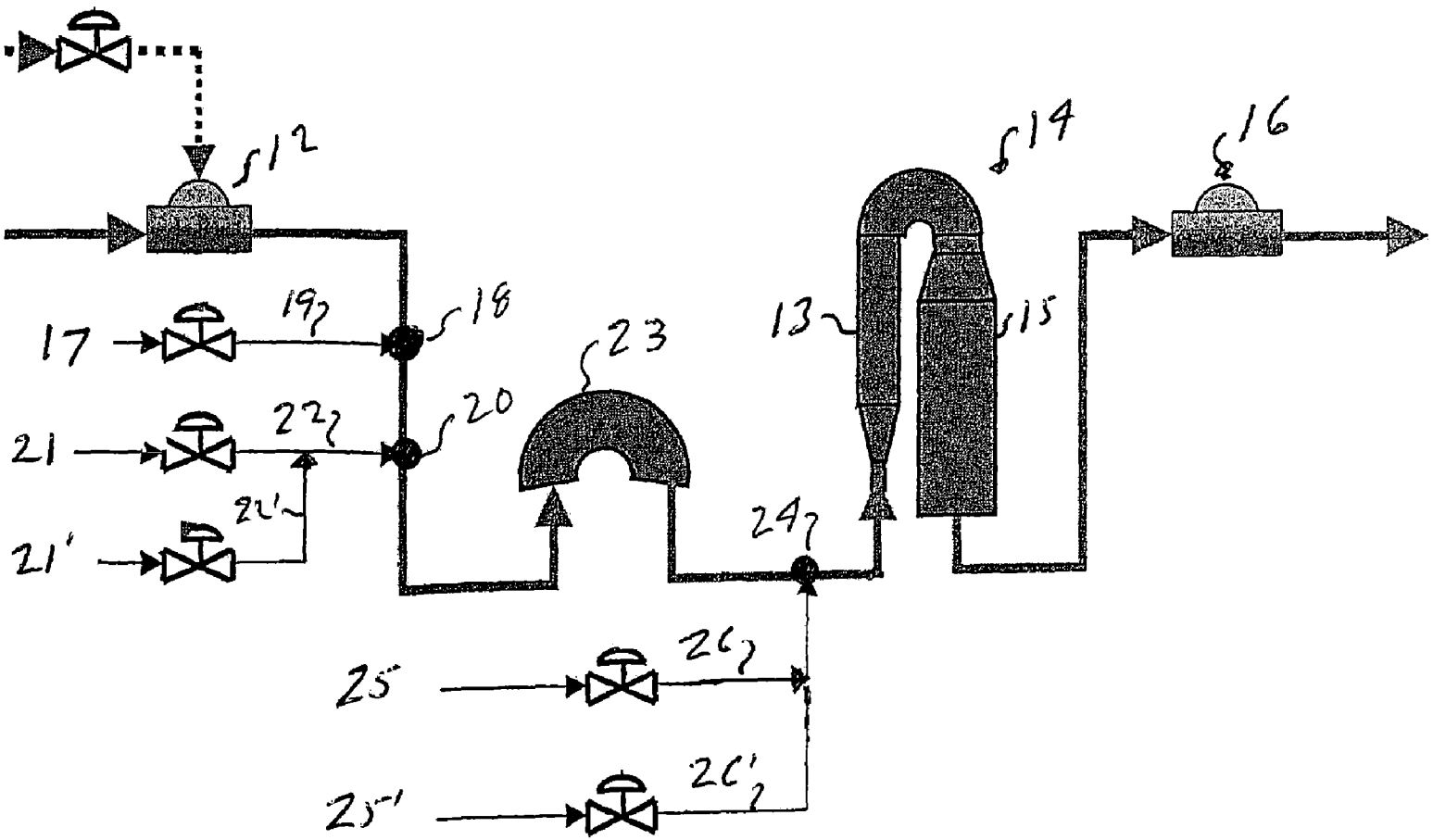

This is shown in FIGS. 2 and 3. These are different representations of the process.

There is an additional mixer and a reaction chamber between the washer 12 and the chlorine dioxide tower 14.

The pump 18 mixes a base chemical with the pulp slurry. The base chemical is any chemical which will provide an appropriate pH for the slurry. Sodium hydroxide or sodium carbonate are preferred. Sodium hydroxide is the most preferred because it is the chemical used in the extraction reaction and no new chemical is required. The base chemical is supplied from unit 17 through line 19. The base chemical may be supplied to the slurry either before or at the pump 18. The base chemical should be mixed thoroughly with the slurry before the addition of the carboxylation chemicals.

The mixer 20 mixes the carboxylation chemicals with the pulp slurry. The carboxylation chemicals are supplied from units 21 or 21' through lines 22 and 22'. The carboxylation chemicals may be supplied to the slurry either before or at mixer 20. The carboxylation chemicals may be any of those mentioned. The preferred secondary oxidant is chlorine dioxide. The preferred primary oxidant is triacetoneamine ethylene glycol ketal (TAA-EGK).

The pulp slurry then enters the reaction chamber 23 in which the first stage of the carboxylation process occurs. The size of the reaction chamber 23 will depend on the length of time of the catalytic oxidation reaction. The reaction chamber will be a tank if the reaction is over 1 minute. It will be a good-sized tank if the reaction is over 2 minutes and a large tank if the reaction is over 15 minutes. The reaction chamber 23 can be a pipe if the reaction is under a minute. It will be a large and probably curved pipe, as shown, if the reaction is over 30 seconds. It can be a straight pipe, and possibly the existing pipe, if the reaction is 30 seconds or less. The reaction can be around 15 seconds and can, in certain instances, be as short as 1 second. The diameter and length will be of a size that will accommodate the flow of pulp slurry for the time required for the oxidation reaction.

Mixer 24 mixes the stabilization chemicals with the pulp slurry. The stabilization chemicals are supplied from units 25 and 25' through lines 26 and 26'. The chemicals may be supplied to the slurry either before or at mixer 24. The stabilization chemicals can be any of those mentioned. Alkali metal chlorites, hydrogen peroxide, acid, chlorine dioxide and peracids are among the chemicals that may be used. It is preferred that an acid, such as sulfuric acid, and a peroxide, such as hydrogen peroxide, be used. It is most preferred that an acid be used.

The pulp slurry then enters the upflow section 13 of the chlorine dioxide tower 14 and then transfers to the downflow section 15 of tower 14. The stabilization reaction occurs in tower sections 13 and 15.

While the system has been described in terms of an extraction stage 10, it can also be used in systems in which there are two chlorine dioxide towers separated by a washing stage. The system would be identical to that described herein except that extraction tower 10 would be a chlorine dioxide tower. It may be necessary to use more chlorine dioxide in this system.

It can be seen that the system can be changed from a regular pulp bleach stage to a carboxylation stage may simply adding or removing chemicals from the system. The addition of the base chemicals, the catalyst, the acid and the peroxide turns it into a carboxylation unit, the absence of these chemicals returns it to a standard pulp bleach stage.

Those skilled in the art will recognize that the present invention is capable of many modifications and variations without departing from the scope thereof. Accordingly, the detailed description set forth above is meant to be illustrative only and is not intended to limit, in any manner, the scope of the invention as set forth in the appended claims. It will be noted that other catalytic oxidation and stabilization chemicals may be used, but the chemicals noted are the preferred chemicals.

The invention claimed is:

1. A pulp carboxylation system comprising a pulp bleaching stage, a washer following said pulp bleaching stage, a first mixer following said washer, a supply of basic material connected to said system whereby said base material will be mixed by said first mixer, a second mixer following said first mixer, a supply of carboxylation chemicals connected to said system after said first mixer whereby said carboxylation chemicals will be mixed by said second mixer, a reaction chamber following said second mixer, said reaction chamber being sized for a reaction time of no more than 15 minutes, a third mixer following said reaction chamber, a supply of stabilizing material connected to said system after said reaction chamber whereby said stabilizing material will be mixed by said third mixer, a stabilizing chamber following said third mixer.

2. The carboxylation system of claim 1 in which said reaction chamber is sized for a reaction time of no more than 2 minutes.

3. The carboxylation system of claim 1 in which said reaction chamber is sized for a reaction time of no more than 1 minute.

4. The carboxylation system of claim 1 in which said reaction chamber is sized for a reaction time of no more than 30 seconds.

5. The carboxylation system of claim 1 in which said reaction chamber is sized for a reaction time of no more than 15 seconds.

6. The carboxylation system of claim 1 in which said pulp bleaching stage is an extraction stage.

7. The carboxylation system of claim 6 in which said stabilizing chamber is a chlorine dioxide bleach tower.

8. The carboxylation system of claim 1 in which said pulp bleaching stage is a chlorine dioxide stage.

9. The carboxylation system of claim 8 in which said stabilizing chamber is a chlorine dioxide tower.

10. The carboxylation system of claim 1 in which said stabilizing chamber is a chlorine dioxide bleach tower.

11. The carboxylation system of claim 1 in which said first mixer is a pump.

12. The carboxylation system of claim 1 further comprising a pH meter at the exit of said reaction chamber.

13. The carboxylation system of claim 1 in which said supply of basic material is selected from the group consisting of sodium hydroxide and sodium carbonate.

14. The carboxylation system of claim 1 in which said supply of basic material is connected to said first mixer.

15. The carboxylation system of claim 1 in which said supply of carboxylation chemicals is a sufficient amount of a primary oxidant selected from the group consisting of hindered heterocyclic oxammonium salts in which the carbon atoms adjacent the oxammonium nitrogen lack .alpha.-hydrogen substitution, the corresponding amines, hydroxylamines, and nitroxides of these oxammonium salts, and mixtures thereof, and a secondary oxidant selected from chlorine dioxide and latent sources of chlorine dioxide in a sufficient amount to induce an increase in carboxyl substitution in the carbohydrate of at least 2 meq/100 g.

16. The carboxylation system of claim 1 in which said supply of stabilization chemicals is connected to said second mixer.

17. The carboxylation system of claim 1 in which said supply of stabilizing materials are selected from the group consisting of an alkali metal chlorite, a peroxide, an acid, chlorine dioxide, a peracid and mixtures thereof.

18. The carboxylation system of claim 1 in which said supply of stabilizing materials is selected from the group consisting of a peroxide, an acid, and mixtures thereof.

19. The carboxylation system of claim 1 in which said stabilizing material is an acid.

20. The carboxylation system of claim 1 in which said supply of stabilizing materials is connected to said third mixer.

* * * * *